US009583073B1

(12) United States Patent
Xiong et al.

(10) Patent No.: US 9,583,073 B1
(45) **Date of Patent: *Feb. 28, 2017**

(54) ADAPTIVE STARTUP METHOD FOR CONSTANT CURRENT LED DRIVERS

(71) Applicant: Universal Lighting Technologies, Inc., Madison, AL (US)

(72) Inventors: Wei Xiong, Madison, AL (US); Keith Davis, Madison, AL (US)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 56 days.

This patent is subject to a terminal disclaimer.

(21) Appl. No.: 14/624,614

(22) Filed: Feb. 18, 2015

Related U.S. Application Data

(60) Provisional application No. 61/944,667, filed on Feb. 26, 2014.

(51) Int. Cl.
*G09G 3/32* (2016.01)
*G09G 5/10* (2006.01)
*G09G 5/18* (2006.01)

(52) U.S. Cl.
CPC ..... *G09G 5/10* (2013.01); *G09G 3/32* (2013.01); *G09G 5/18* (2013.01)

(58) Field of Classification Search
CPC ..... G09G 2330/02; G09G 2330/021; G09G 2330/022; G09G 2330/023; G09G 2330/024; G09G 3/06; G09G 3/30; G09G 3/32; G09G 3/3233; G09G 3/3241
See application file for complete search history.

(56) References Cited

U.S. PATENT DOCUMENTS

| | | | | |
|---|---|---|---|---|
| 9,125,259 | B1 * | 9/2015 | Xiong | H05B 33/0815 |
| 2011/0037410 | A1 * | 2/2011 | Hsu | H05B 33/0815 315/294 |
| 2012/0049763 | A1 * | 3/2012 | Huang | H05B 33/0812 315/307 |

* cited by examiner

*Primary Examiner* — Premal Patel
(74) *Attorney, Agent, or Firm* — Patterson Intellectual Property Law, PC; Mark J. Patterson; Gary L. Montle

(57) ABSTRACT

A constant current LED driver with adaptive startup voltage control is generally configured to provide output current to an LED load. A controller is configured to sense the output current, and to provide driving control signals as a function thereof to maintain the sensed current at a target current. During startup operation, the controller provides driving control signals further as a function of a first defined maximum output voltage value. During steady state operation, the driving control signals are provided as a function of a second defined maximum output voltage value. The maximum values may be set according to forward voltage drop values for the LED load in association with first and second temperatures, respectively. During transition operations, the maximum output voltage value is continuously adjusted between the first and second maximum output voltage values, such that the LED load exceeds its warm up time prior to steady state operation.

18 Claims, 5 Drawing Sheets

ADAPTIVE STARTUP METHOD FOR CONSTANT CURRENT LED DRIVERS

CROSS-REFERENCES TO RELATED APPLICATIONS

This application claims benefit of U.S. Provisional Patent Application No. 61/944,667, filed Feb. 26, 2014, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to circuitry and methods for providing constant current to a light source such as an LED load. More particularly, the present invention relates to an adaptive startup voltage control for a constant current LED driver.

Light emitting diode ("LED") lighting is growing in popularity due to decreasing costs and long life compared to incandescent lighting and fluorescent lighting. LED lighting can also be dimmed without impairing the useful life of the LED light source, and is generally effective in extremely cold environments, such as for example −40 degrees Celsius (° C.).

Generally speaking, LED lighting applications are designed to control the output current in the load and not the voltage, as the forward voltage of an LED load can vary dramatically, for example as a function of temperature, and a fixed voltage output would likewise produce varying output current and lighting output levels. Conventional LED drivers therefore sense an output current provided to the load and a feedback circuit implemented by the controller maintains the output current to a substantially constant value.

However, as the current flow through the LED load may vary as a function of temperature, the brightness of the LED lighting output may change along with the temperature of the LED load even while the current supplied from the LED driver remains substantially constant. Therefore, at least for certain temperature variations, the output current from the driver circuit to the LED load must vary as a function of temperature in order to maintain appropriately constant lighting output.

A typical representation of forward voltage drop characteristics for an LED load versus temperature is shown in FIG. 1. As represented in FIG. 1, the incremental forward voltage drop for an LED load is relatively flat, or in other words substantially unchanging, after the temperature of the load exceeds about 20 degrees Celsius. However, the load voltage may be dramatically higher at −40 degrees Celsius than a voltage for the same LED load at a temperature such as 20 degrees Celsius, and typically it could approach levels 30% higher or more.

This forward drop voltage differential for loads at such different temperatures is a challenge for LED driver designers. When an LED load reaches steady state operation at full bright lighting output, it is generally hot enough to maintain a reasonably high temperature (for example >20 degrees Celsius) because LEDs generate heat after a relatively short warm up time. LED driver designs typically include a maximum output voltage to limit the output power of the driver. This maximum output voltage limit typically is designed around the forward voltage drop at the steady state temperature (e.g., around 20° C.).

However, again with reference to the characteristic curve in FIG. 1, if the temperature at startup is around −40° C. the forward voltage of the LED load will be much greater than the voltage at 20° C. The driver circuit might not be able to start the LED load at −40° C. or otherwise maintain full current if the driver output voltage limit is set around Vf+20 (i.e., forward drop at +20° C.). If the LED driver design is accordingly modified to force the maximum output voltage limit to be the forward drop at −40° C., the LED driver output voltage will by necessity be over-designed for steady state operation, with a power limit substantially 30% higher or even more with respect to a desired configuration. This over-voltage design is highly undesirable, as it would typically increase the product cost and size dramatically.

BRIEF SUMMARY OF THE INVENTION

Circuits and methods as disclosed herein are implemented to reliably start an LED load at cold temperatures and to adaptively adjust the power output as the LED load approaches steady state operation, and thereafter, without electrically and thermally over-designing the LED driver circuit and associated power train components. LED drivers with a controller as disclosed herein therefore improve the driver starting capability while maintaining a relatively low product cost by allowing for the selection of low output voltage limits in power train design.

In an exemplary embodiment, a constant current LED driver with adaptive startup voltage control is generally configured to provide output current to an LED load. A controller is configured to sense the output current, and to provide driving control signals to the LED driver as a function thereof to maintain the sensed current at a target current. During startup modes of operation, the controller provides driving control signals further as a function of a first defined maximum output voltage value for the LED driver circuit. During steady state modes of operation, the driving control signals are provided as a function of a second defined maximum output voltage value.

In one aspect of the LED driver with adaptive startup voltage control, the controller may be programmed to operate in the startup mode for a first time duration after startup of the LED driver circuit. During a subsequent transition mode of operation, the maximum output voltage value may be continuously adjusted between the first and second maximum output voltage values over a second time duration, such that the LED load exceeds its warm up time prior to steady state operation.

In one aspect, the first time duration may be set such that the LED load exceeds its warm up time prior to steady state operation. In another and potentially alternative aspect, the first and second time durations may collectively be set to exceed a warm up time associated with the LED load.

In another aspect, the controller may be programmed wherein the startup mode of operation is initiated by the controller programming upon each startup of the LED driver circuit. In another aspect, the steady state mode of operation may be initiated by the controller programming upon completion of the second time duration and maintained for the duration of operation of the LED driver circuit.

In another aspect of the LED driver with adaptive startup voltage control, the first maximum output voltage value for the LED driver circuit may be associated with a forward voltage drop for the LED load at a first temperature. The second maximum output voltage value for the LED driver circuit may be associated with a forward voltage drop for the LED load at a second temperature. As one example of such an aspect, the first temperature may be about −40 degrees Celsius, and the second temperature may be about 20 degrees Celsius.

In another aspect of the LED driver with adaptive startup voltage control, the controller may be configured with an input to receive a dimming signal from a dimming circuit, and is further operable to control the current provided to the LED load further as a function of the received dimming signal by adjusting the target current as a function of the received dimming signal.

BRIEF DESCRIPTION OF THE SEVERAL VIEWS OF THE DRAWINGS

Where the various figures may describe embodiments sharing various common elements and features with other embodiments, similar elements and features are given the same reference numerals and redundant description thereof may be omitted below.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Figure 1:
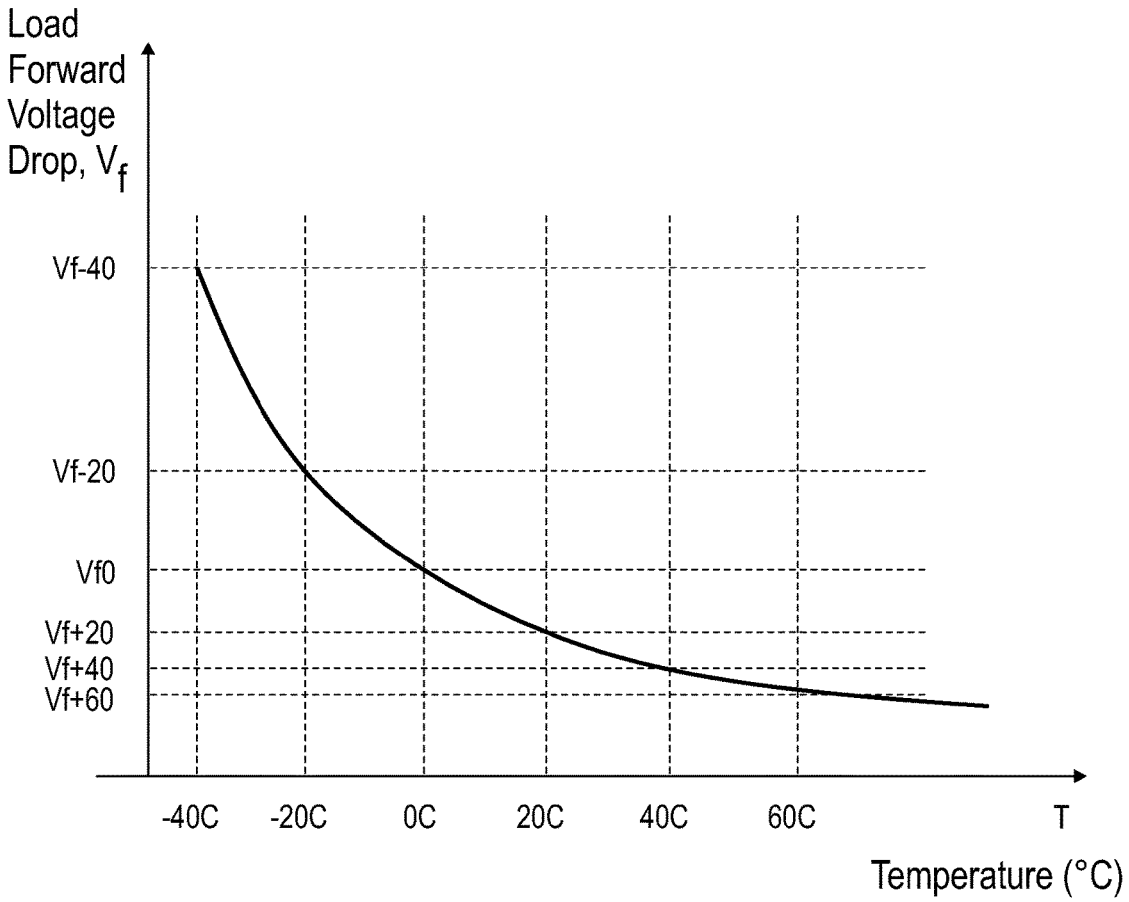
FIG. 1 is a graphical plot representing forward voltage for an LED load versus temperature.
Figure 2:
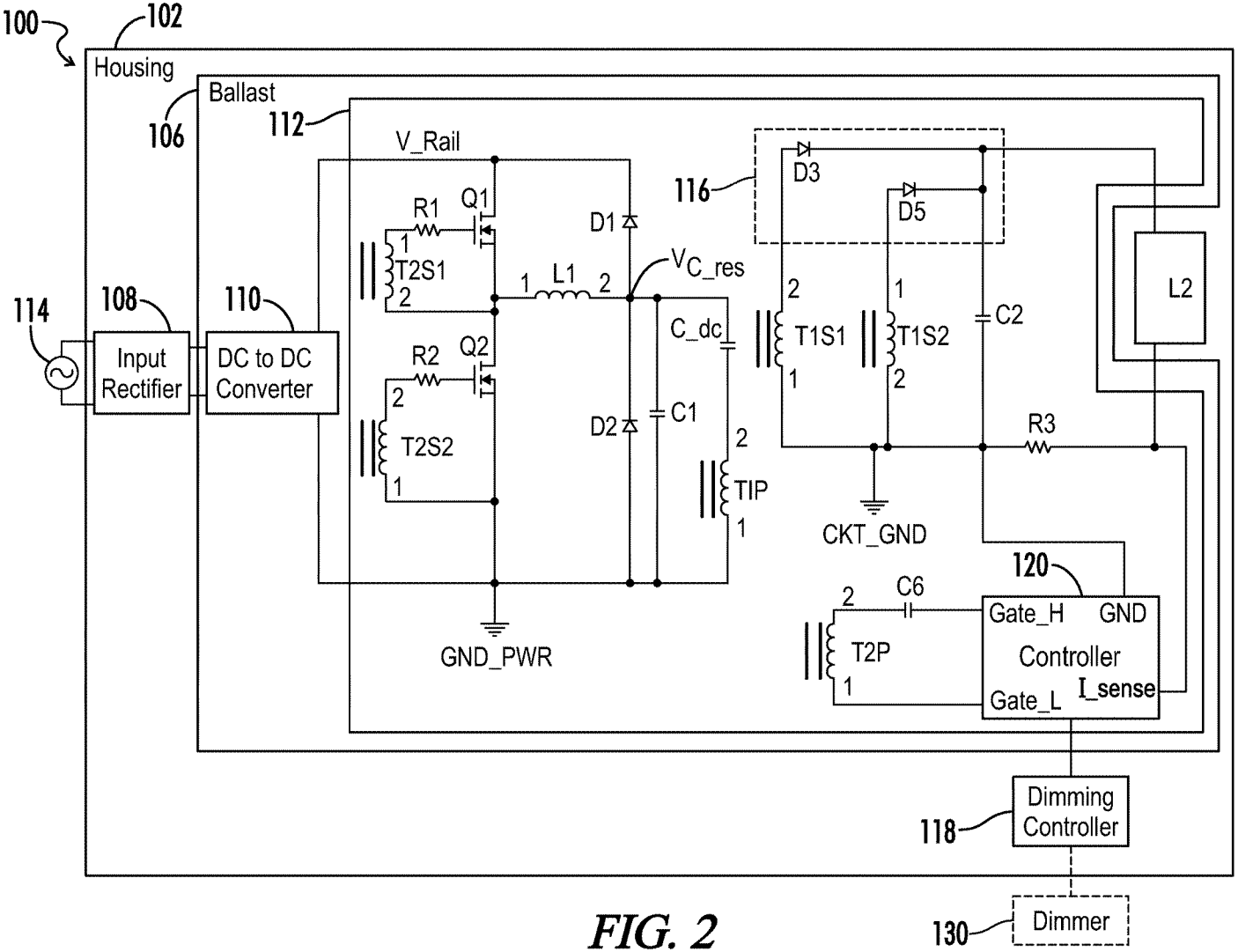
FIG. 2 is a block diagram and partial schematic diagram of an exemplary light fixture including a light source and a ballast in accordance with an embodiment of the present disclosure.

Referring to FIG. 2, a particular but non-limiting embodiment of a light fixture 100 of the present disclosure includes a housing 102, an electronic ballast 106 and a light source L2. The light fixture 100 receives power from an alternating current (AC) power source 114 and provides light from the light source L2. The light source L2 provides light in response to receiving current. The housing 102 is connected to the ballast 106 and the light source L2. In one embodiment, the housing 102 supports the ballast 106 and the light source L2 in a predetermined spatial relationship. In preferred embodiments, the light source L2 is a plurality of series and/or parallel connected light emitting diodes (LEDs). In one embodiment, the light fixture 100 also includes a dimming circuit that provides a dimming signal to a controller 120 of the ballast 106. The dimming signal is indicative of a target current or light intensity level for the light source L2.

The ballast 106 provides current to the light source L2 from the AC power source 114. The ballast 106 includes an input rectifier 108 and a driver circuit 112. The input rectifier 108 connects to the AC power source 114 and provides a DC power source having a power rail V_RAIL and a ground GND_PWR at an output of the input rectifier 108. In one embodiment, the ballast 106 also includes a DC-to-DC converter 110 connected between the input rectifier 108 and the driver circuit 112. The DC-to-DC converter 110 alters a voltage of a power rail V_RAIL of a DC power source provided by the input rectifier 108. The driver circuit 112 provides current to the light source L2 from the DC power source provided by the input rectifier 108.

The driver circuit 112 includes a half-bridge inverter, a resonant tank circuit, an isolating transformer T1, an output rectifier 116, and a controller 120. The driver circuit 112 as shown is configured to operate as a constant current source with a self-limiting output voltage, but the clamping elements and associated operation as further described herein is merely exemplary and is particularly non-limiting with respect to the adaptive startup voltage control method as further disclosed below.

The driver circuit 112 is further optionally dimmable such that the constant current can be changed. The half-bridge inverter includes a first switch Q1 (i.e., a high side switch) and a second switch Q2 (i.e., a low side switch) and has an input and an output. The input of the half-bridge inverter connects to the power rail V_RAIL and the ground PWR_GND of the DC power source and provide an AC signal at the output of the half-bridge inverter. In one embodiment, the input of the half-bridge inverter is a high side of the high side switch. A low side of the low side switch (e.g., second switch Q2) connects to the ground of the DC power source.

The resonant tank circuit conventionally includes a resonant inductor L1 and a resonant capacitor C1, and further in accordance with the example shown in FIG. 2, includes a first clamping diode D1 and a second clamping diode D2. The resonant tank circuit has an input and an output. The input of the resonant tank circuit (e.g., a first terminal of a resonant inductor L1) is connected to the output of the half-bridge inverter. The resonant capacitor C1 is connected in series with the resonant inductor L1 between the output of the half-bridge inverter and the ground GND_PWR of the DC power source. The first clamping diode D1 has an anode connected to a junction formed at the connection between the resonant inductor L1 and a resonant capacitor C1. The cathode of the first clamping diode D1 is connected to the power rail V_RAIL of the DC power source. The second clamping diode D2 has an anode connected to the ground PWR_GND of the DC power source and a cathode connected to the junction between the resonant capacitor C1 and the resonant inductor L1. In one embodiment, the resonant tank circuit includes a DC blocking capacitor C_dc connected between the junction of the resonant inductor L1 and resonant capacitor C1 and the output of the resonant tank circuit. The first clamping diode D1 and the second clamping diode D2 cooperate to limit the voltage at the junction between the resonant inductor L1 and a resonant capacitor C1 to a maximum voltage equal to the voltage of the power rail V_RAIL of the DC power source and a minimum voltage equal to the ground PWR_GND of the DC power source.

In an embodiment, an isolating transformer T1 is connected to the output of the resonant tank circuit. The isolating transformer T1 includes a primary winding T1P and a secondary winding T1S1, T1S2. The primary winding T1P is connected between the output of the resonant tank circuit and the ground PWR_GND of the DC power source. The output rectifier 116 has an input connected to the secondary winding T1S1, T1S2 of the isolating transformer and an output operable to connect to the light source L2. In one embodiment, the turns ratio of the isolating transformer is selected as a function of a voltage of the power rail V_RAIL of the DC power source and a predetermined output voltage limit. In one embodiment, the output voltage limit is 60 VDC.

The controller 120 senses current provided to the light source L2 from the output rectifier 116 and adjusts a switching frequency of the half-bridge inverter as a function of the sensed current to maintain the sensed current at a target current. In one embodiment, the target current is determined as a function of the dimming signal provided by the dimming controller 118. The controller 120 further controls the current provided to the light source L2 as a function of the received dimming signal by adjusting the target current as a function of the received dimming signal. In one embodiment, the controller 120 adjusts the current provided to the light source L2 by adjusting a switching frequency of the half-bridge inverter.

Figure 3:
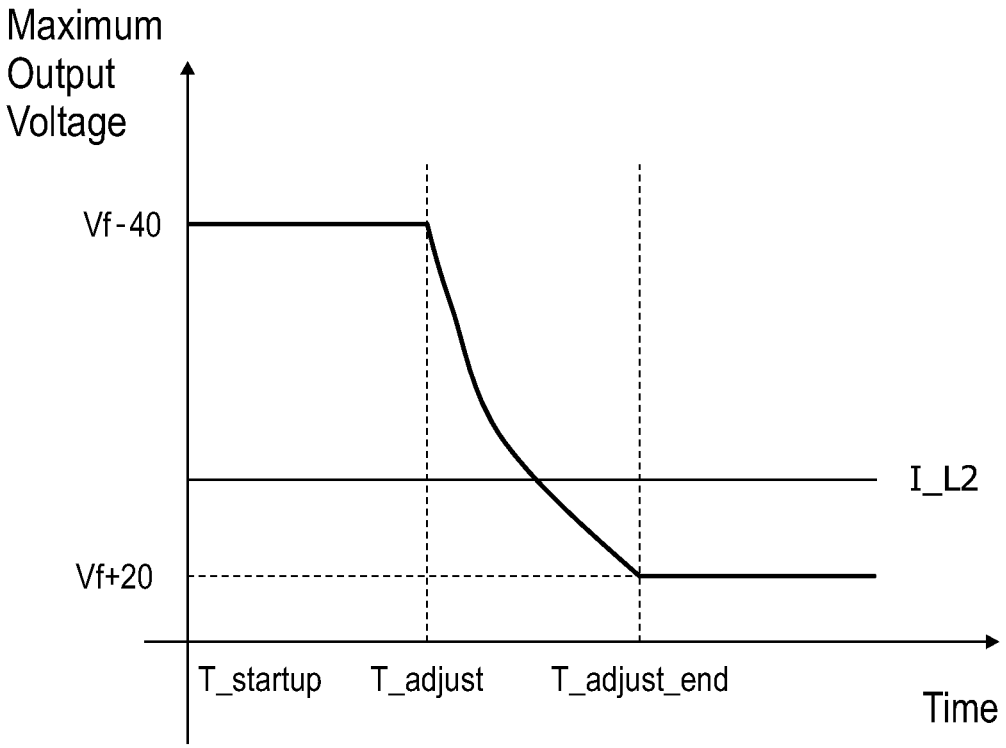
FIG. 3 is a graphical plot representing an embodiment of an adaptive startup voltage control process for a constant current LED driver according to the present disclosure.

Referring to an embodiment as shown in FIG. 3, the controller 120 employs an adaptive startup voltage limit control for a constant current power source that provides constant current output to a light source throughout at least a startup operating mode. In the following description for this process, the light source will be referenced in exemplary fashion as an LED load. In the example shown, upon LED startup, the controller 120 for the LED driver sets the output voltage limit V_output_limit around Vf−40 so that the driver can continuously provide the full amount of constant current I_LED_constant even when the relevant temperature is at −40° C. This high output voltage limit will remain as the setting for a certain amount of time, or otherwise stated for the duration of the startup mode of operation, until a transition mode of operation beginning with time T_adjust, a duration for which could be set long enough to warm up the LED load to 20° C. In some embodiments, the startup mode of operation itself may have a set duration to exceed the expected warm up time of the LED load.

By the time of T_adjust, LED driver will receive signals from the controller 120 to gradually reduce the output voltage limit from Vf−40 to Vf+20. At the time T_adjust_end, the LED driver would enter a steady state mode of operation and the maximum output voltage of LED driver will be permanently set at Vf+20.

In various embodiments, every time the LED driver is started, or otherwise initially is connected to and receives power input from the AC source 114, the LED driver control operation will go through the output voltage adaptive adjustment curve shown in FIG. 3. Because the LED driver only needs to function for a short period of time at the high output voltage limit or higher output power limit, the power train doesn't have to be over-designed for higher thermal or electrical stress. This may typically have the effect of substantially reducing production cost and product reliability.

Referring again to FIG. 2, in one embodiment the secondary winding T1S1, T1S2 of the isolating transformer is connected to a circuit ground CKT_GND which is isolated from the ground PWR_GND of the DC power source by the isolating transformer. Specifically, the secondary winding includes first secondary winding T1S1 and second secondary winding T1S2, each connected to the circuit ground CKT_GND. The first secondary winding T1S1 and the second secondary winding T1S2 are connected out of phase with one another.

The output rectifier includes a first output diode D3 and a second output diode D5. The first output diode D3 has its anode connected to the first secondary winding T1S1 and a cathode coupled to the light source L2 (i.e., an output of the driver circuit 112 and ballast 106). The second output diode D5 has an anode connected to the second secondary winding T1S2 and a cathode coupled to the light source L2 (i.e., the output of the driver circuit 112 and ballast 106).

In one embodiment, an output capacitor C2 is connected between the output of the output rectifier 116 and the circuit ground CKT_GND to smooth or stabilize the output voltage of the driver circuit 112 and ballast 106. In one embodiment, a current sensing resistor R3 is connected between the circuit ground CKT_GND and the light source L2. A first terminal of the current sensing resistor R3 is connected to the circuit ground CKT_GND, and a second terminal of the current sensing resistor is operable to connect to the light source L2. Thus, a voltage across the current sensing resistor is proportional to a current through the light source L2. The controller 120 is connected to the circuit ground CKT_GND and the second terminal of the current sensing resistor R3 to monitor the voltage across the current sensing resistor and sense the current provided to the light source L2 by the ballast 106.

In one embodiment, the driver circuit 112 further includes a gate drive transformer. The gate drive transformer is operable to receive the gate drive signal from the controller 120 which controls the switching frequency of the half-bridge inverter. The gate drive transformer includes a primary winding T2P a first secondary winding T2S1, and a second secondary winding T2S2. In this embodiment, the first switch Q1 and the second switch Q2 of the half-bridge inverter each have a high terminal, a low terminal, and a control terminal. The high terminal of the first switch Q1 is connected to the power rail V_RAIL of the DC power source. The low terminal of the second switch Q2 is connected to the ground PWR_GND of the DC power source. The high terminal of the second switch Q2 is connected to the low terminal of the first switch Q1. A gate drive capacitor C6 is connected in series with the primary winding T2P of the gate drive transformer across a gate drive output (i.e., gate_H and gate_L) of the controller 120. A first gate drive resistor R1 is connected in series with the first secondary winding T2S1 of the gate drive transformer between the control terminal of the first switch Q1 and the output of the half-bridge inverter. A second gate drive resistor R2 is connected in series with the second secondary winding T2S2 of the gate drive transformer between the control terminal of the second switch Q2 and the ground PWR_GND of the DC power circuit. The polarity of the first secondary winding T2S1 and the second secondary winding T2S2 of the gate drive transformer are opposites such that the first switch Q1 and the second switch Q2 are driven out of phase by the gate drive transformer.

Figure 4:
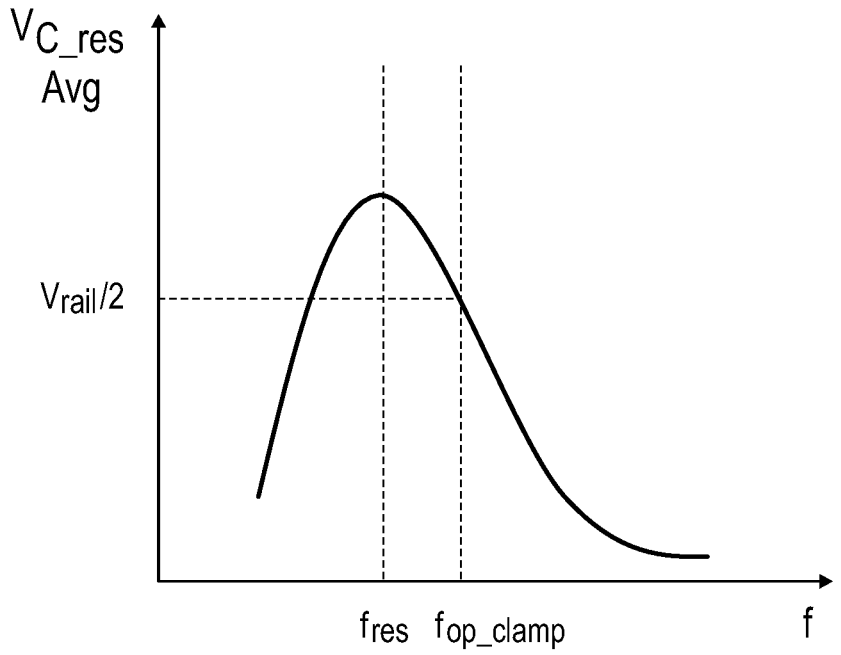
FIG. 4 is a graphical plot of average voltage of the resonant capacitor versus switching frequency for a driver circuit topology that does not include clamping diodes.

Referring to FIG. 4, a plot of average resonant capacitor voltage $V_{C_res}$ versus frequency is shown for a driver circuit topology that does not include the first clamping diode D1 and the second clamping diode D2. Because the voltage $V_{C_res}$ of the resonant capacitor C1 is not clamped or limited, the voltage $V_{C_res}$ of the resonant capacitor C1 can be much greater than one-half the voltage of the power rail V_RAIL of the DC power source.

In contrast, in embodiments of the driver circuit 112 which include the first clamping diode D1 and the second clamping diode D2, the average voltage $V_{C_res}$ of the resonant capacitor C1 is clamped at one-half the voltage of the power rail V_RAIL (i.e., V_RAIL/2 in FIG. 3), regardless of the operating (i.e., switching) frequency of the half-bridge inverter because the instantaneous voltage of the resonant capacitor is clamped at the voltage of the power rail V_RAIL. The maximum frequency at which the first clamping diode D1 and the second clamping diode D2 limit the voltage of the resonant capacitor C1 is the clamping frequency $f_{op_clamp}$. Above the clamping frequency $f_{op_clamp}$, the average voltage of the resonant capacitor C1 is less than V_RAIL/2.

Thus, when the operating frequency (i.e., switching frequency) of the half-bridge inverter is less than the clamping frequency $f_{op_clamp}$, the voltage $V_{C_res}$ of the resonant capacitor C1 is still limited to one-half the voltage of the power rail V_RAIL. So even when the switching frequency is at the resonant frequency $f_{res}$ of the resonant tank, the average voltage $V_{C_res}$ across the resonant capacitor C1 will be limited to one-half the voltage of the power rail V_RAIL, but reducing the frequency below the clamping frequency $f_{op_clamp}$ (e.g., to the resonant frequency $f_{res}$ of the resonant tank circuit) can provide more current to the primary winding T1S1 of the isolating transformer. The driver circuit 112 can thus provide additional current to the light source L2 without increasing the output voltage of the driver circuit 112 by decreasing the operating frequency of the half-bridge inverter.

Figure 5:
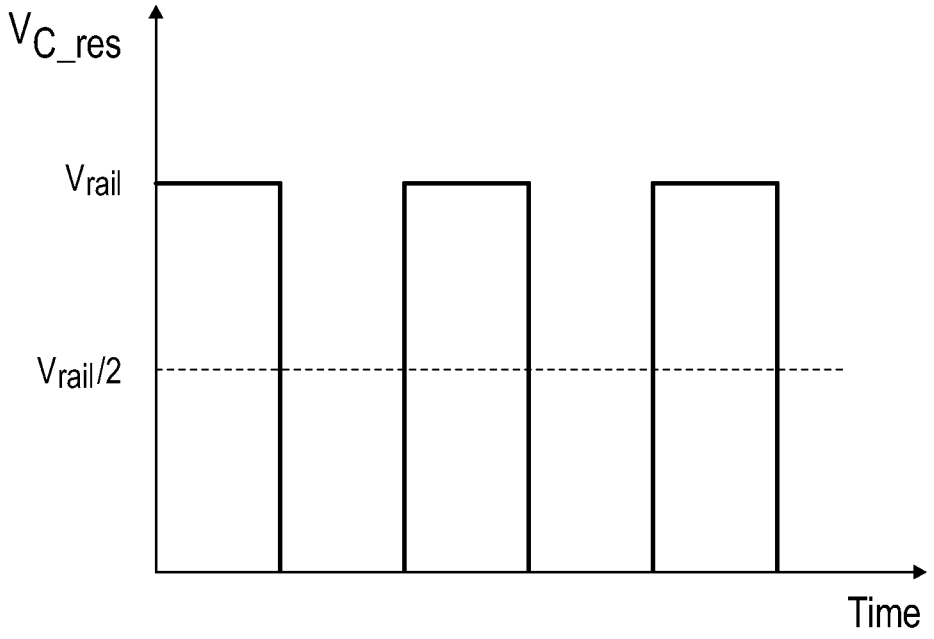
FIG. 5 is a plot of voltage of the resonant capacitor versus time for a switching frequency that is less than the resonant frequency of the resonant tank circuit.
Figure 6:
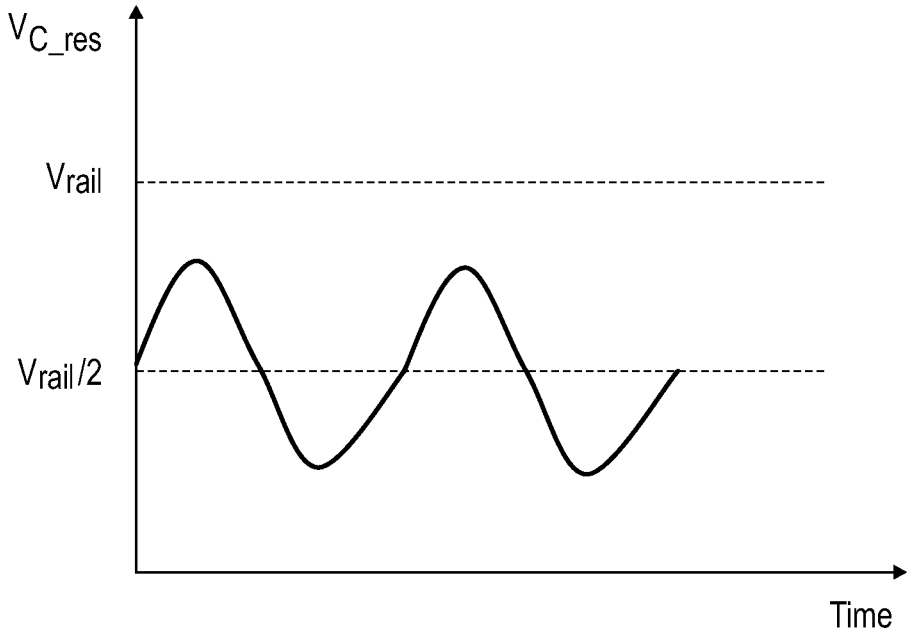
FIG. 6 is a plot of voltage of the resonant capacitor versus time for a switching frequency that is greater than the resonant frequency of the resonant tank circuit.

Referring now to FIG. 5, the voltage waveform for the resonant capacitor C1 is shown for an operating frequency that is less than the resonant frequency $f_{res}$ of the resonant tank circuit. Referring to FIG. 6, the voltage waveform for the resonant capacitor C1 is shown for an operating frequency that is greater than the resonant frequency $f_{res}$ of the resonant tank circuit.

Because the maximum voltage across the resonant capacitor C1 is clamped, the maximum peak voltage across the isolating transformer primary winding T1S1 is also clamped. Thus, if the turns ratio N of the isolating transformer is selected such that $$N = \frac{\text{V_RAIL}}{2} * \frac{1}{60},$$

then the secondary winding voltage of the isolating transformer will never exceed 60 Volts (i.e., the UL Class-2 Limit). The half-bridge inverter and the resonant tank circuit is thus a voltage source with a self-clamped output voltage.

Further, because the voltage $V_{C_res}$ across the resonant capacitor C1 is limited to V_RAIL/2, the half-bridge inverter that drives the resonant tank circuit will always operate in a soft-switching condition. This reduces the switching losses and increases the efficiency of the driver circuit 112.

Referring again to FIG. 4, the voltage $V_{C_res}$ across the resonant capacitor C1 can vary between V_RAIL/2 and 0 volts. The driver circuit 112 can thus drive any light source L2 (e.g., any LED configuration) from the predetermined maximum output voltage (e.g., 60 volts) to the minimum voltage (i.e., 0 volts).

In one embodiment, the driver circuit 112 includes a series resonant inverter that has a self-limited output voltage. The series resonant inverter exhibits half-bridge soft-switching under all operating conditions. The driver circuit 112 operates as a constant current source that has a self-limited output voltage and that that has a wide output voltage operating range. The driver circuit 112 can be controlled by an external reference signal (i.e., a dimming signal from a dimmer 130 interfacing with the dimming controller 118) to provide a dimming function.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "circuit" means at least either a single component or a multiplicity of components, either active and/or passive, that are coupled together to provide a desired function. As used herein, "ballast" refers to any circuit for providing power from a power source to a light source. Additionally, "light source" refers to one or more light emitting devices such as fluorescent lamps, high intensity discharge lamps, incandescent bulbs, and solid state light-emitting elements such as LEDs, organic light emitting diodes, and plasmaloids. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

The terms "switching element" and "switch" may be used interchangeably and may refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A controller for an LED driver circuit configured to provide an output current to an LED load, the controller comprising:

at least a first input to receive a sensed current provided to the LED load;

at least a first output to provide driving control signals to the LED driver circuit as a function of the sensed current to maintain the sensed current at a target current;

wherein the controller is programmed during a startup mode of operation to provide driving control signals further as a function of a first defined maximum output voltage value for the LED driver circuit, wherein the controller is programmed during a steady state mode of operation to provide driving control signals further as a function of a second defined maximum output voltage value;

at least a second input to receive a dimming signal from a dimming circuit; and wherein the controller is operable to control the current provided to the LED load further as a function of the received dimming signal by adjusting the target current as a function of the received dimming signal.

2. The controller of claim 1, wherein the controller is programmed to operate in the startup mode for a first time duration after startup of the LED driver circuit.

3. The controller of claim 2, wherein the controller is further programmed during a transition mode of operation to adjust a maximum output voltage value for the LED driver circuit from the first maximum output voltage value to the second maximum output voltage value over a second time duration.

4. The controller of claim 3, wherein the controller is programmed during the transition mode of operation to provide a continuous adjustment of the maximum output voltage value for the LED driver circuit from the first maximum output voltage value to the second maximum output voltage value over the second time duration.

5. The controller of claim 3, wherein the first and second time durations collectively exceed a warm up time associated with the LED load.

6. The controller of claim 3, wherein the startup mode of operation is initiated by the controller programming upon each startup of the LED driver circuit.

7. The controller of claim 6, wherein the steady state mode of operation is initiated by the controller programming upon completion of the second time duration and is maintained for the duration of operation of the LED driver circuit.

8. The controller of claim 1, wherein the first maximum output voltage value for the LED driver circuit is associated with a forward voltage drop for the LED load at a first temperature, and the second maximum output voltage value for the LED driver circuit is associated with a forward voltage drop for the LED load at a second temperature.

9. The controller of claim 8, wherein the first temperature is −40 degrees Celsius, and the second temperature is 20 degrees Celsius.

10. A method of providing adaptive startup voltage control for an LED driver circuit, the method comprising:

initiating a startup mode of operation based on sensed input power to the LED driver circuit;

during a duration of the startup mode of operation, providing driving control signals to the LED driver circuit as a function of a sensed current provided to an LED load to maintain the sensed current at a target current, and further as a function of a first defined maximum output voltage value;

during a steady state mode of operation, providing driving control signals to the LED driver circuit as a function of a sensed current provided to the LED load to maintain the sensed current at a target current, and further as a function of a second maximum output voltage value;

receiving a dimming signal from a dimming circuit; and controlling the current provided to the LED load further as a function of the received dimming signal by adjusting the target current as a function of the received dimming signal.

11. The method of claim 10, the duration of the startup mode of operation comprising a first time duration, the method further comprising:

during a transition mode of operation, adjusting a maximum output voltage value for the LED driver circuit from the first maximum output voltage value to the second maximum output voltage value over a second time duration.

12. The method of claim 11, wherein during the transition mode of operation the maximum output voltage value for the LED driver circuit is continuously adjusted from the first maximum output voltage value to the second maximum output voltage value over the second time duration.

13. The method of claim 11, wherein the first and second time durations collectively exceed a warm up time associated with the LED load.

14. The method of 11, further comprising initiating the steady state mode of operation upon completion of the second time duration and maintaining the steady state mode of operation for the duration of operation of the LED driver circuit.

15. The method of claim 10, wherein the first maximum output voltage value for the LED driver circuit is associated with a forward voltage drop for the LED load at a first temperature, and the second maximum output voltage value for the LED driver circuit is associated with a forward voltage drop for the LED load at a second temperature.

16. The method of claim 15, wherein the first temperature is −40 degrees Celsius, and the second temperature is 20 degrees Celsius.

17. A driver circuit operable to provide current to a light source from a direct current (DC) power source having a power rail and a ground, the driver circuit comprising:

an inverter circuit having an input and an output, wherein the input is configured to connect to the power rail and the ground of the DC power source and to provide an alternating current (AC) signal at the output;

a resonant tank circuit having an input connected to the output of the inverter circuit and an output, the resonant tank circuit comprising a resonant inductor and a resonant capacitor connected between the output of the inverter circuit and the ground of the DC power source;

an isolating transformer connected to the output of the resonant tank circuit, the isolating transformer comprising a primary winding connected between the output of the resonant tank circuit and the ground of the DC power source, and a secondary winding;

an output rectifier having an input connected to the secondary winding of the isolating transformer and an output operable to connect to the light source; and a controller configured to sense current provided to the light source from the output rectifier and adjust a switching frequency of the half-bridge inverter as a function of the sensed current to maintain the sensed current at a target current, wherein the controller programmed during a startup mode of operation to adjust the switching frequency of the half-bridge inverter further as a function of a first defined maximum output voltage value for the driver circuit, and wherein the controller is programmed during a steady state mode of operation to adjust the switching frequency of the half-bridge inverter further as a function of a second defined maximum output voltage value.

18. The driver circuit of claim 17, wherein the duration of the startup mode of operation comprises a first time duration, and wherein the controller is programmed during a transition mode of operation to adjust a maximum output voltage value for the LED driver circuit from the first maximum output voltage value to the second maximum output voltage value over a second time duration.

* * * * *